US009517505B2

(12) United States Patent
Delsine et al.

(10) Patent No.: US 9,517,505 B2
(45) Date of Patent: Dec. 13, 2016

(54) TUBE FOR POURING LIQUID METAL, ASSEMBLY OF A TUBE AND A METAL FRAME AND METAL FRAME

(75) Inventors: Damien Delsine, Saint-Ghislain (BE); Mariano Collura, Bracquegnies (BE)

(73) Assignee: Vesuvius Group S.A., Ghlin (BE)

( * ) Notice: Subject to any disclaimer, the term of this patent is extended or adjusted under 35 U.S.C. 154(b) by 428 days.

(21) Appl. No.: 13/880,426

(22) PCT Filed: Oct. 19, 2011

(86) PCT No.: PCT/EP2011/005248

§ 371 (c)(1),
(2), (4) Date: Apr. 19, 2013

(87) PCT Pub. No.: WO2012/052164

PCT Pub. Date: Apr. 26, 2012

(65) Prior Publication Data

US 2013/0228597 A1 Sep. 5, 2013

(30) Foreign Application Priority Data

Oct. 20, 2010 (EP) ..... 10188179

(51) Int. Cl.
*B22D 41/50* (2006.01)
*B22D 41/56* (2006.01)

(52) U.S. Cl.
CPC ..... *B22D 41/50* (2013.01); *B22D 41/502* (2013.01); *B22D 41/56* (2013.01)

(58) Field of Classification Search
CPC ..... B22D 41/502; B22D 41/50; B22D 41/56; F27D 3/14; F27D 3/1509
USPC ..... 222/591, 600, 597, 606, 607; 164/437, 164/335, 435; 266/236
See application file for complete search history.

(56) References Cited

U.S. PATENT DOCUMENTS

| | | | | |
|---|---|---|---|---|
| 1,635,839 | A * | 7/1927 | Hassall et al. | 137/801 |
| 3,797,712 | A * | 3/1974 | Kutzer et al. | 222/591 |
| 4,819,840 | A * | 4/1989 | Lax et al. | 222/606 |
| 4,993,608 | A * | 2/1991 | Thorner | 222/607 |
| 5,858,260 | A * | 1/1999 | Daussan et al. | 222/602 |

(Continued)

FOREIGN PATENT DOCUMENTS

| | | |
|---|---|---|
| EP | 1199121 A1 | 4/2002 |
| JP | 5123837 A | 5/1993 |

(Continued)

*Primary Examiner* — Scott Kastler
*Assistant Examiner* — Michael Aboagye
(74) *Attorney, Agent, or Firm* — Thomas Clinton; Donald M. Satina

(57) ABSTRACT

A tube for pouring liquid metal has a pouring channel with a pouring axis. The tube has a downstream part with a pouring channel with an outlet diameter, and a flared upstream part with a length known as the threshold distance. The threshold distance is greater than four times the outlet diameter. The upstream part is flared and configured so that its upper end has a convex overall shape in the axial direction. The upstream part is included within a first volume corresponding to the complementary part of an axisymmetric frustoconical volume having as its axis the pouring axis. The generatrix of the volume forms an angle greater than 5 degrees with the pouring axis. The upstream part is included within a second volume, delimited by a surface of revolution generated by an isosceles trapezium revolving about the pouring axis.

14 Claims, 2 Drawing Sheets

(56) References Cited

U.S. PATENT DOCUMENTS

| | | | | |
|---|---|---|---|---|
| 6,409,056 | B1 * | 6/2002 | Lee | 222/606 |
| 2001/0035438 | A1 * | 11/2001 | Ando et al. | 222/606 |
| 2008/0210719 | A1 * | 9/2008 | Guillo et al. | 222/590 |
| 2010/0251533 | A1 | 10/2010 | Yamamoto et al. | |

FOREIGN PATENT DOCUMENTS

| | | | |
|---|---|---|---|
| JP | H09-276997 | A | 10/1997 |
| JP | H09276997 | * | 10/1997 |
| JP | 2002001496 | A | 1/2002 |
| JP | 2009160609 | A | 7/2009 |
| WO | 2006/015460 | A1 | 2/2006 |

* cited by examiner

TUBE FOR POURING LIQUID METAL, ASSEMBLY OF A TUBE AND A METAL FRAME AND METAL FRAME

BACKGROUND OF THE INVENTION (1) Field of the Invention

The present invention relates to the technical field of the continuous casting of liquid metal. It relates in particular to a tube for pouring liquid metal from a metallurgical container.

(2) Description of Related Art

The prior art already discloses an installation for casting liquid metal, notably liquid steel, in which installation metal is transferred from a first metallurgical container to a second container. For example, the metal is transferred from a casting ladle to a tundish, or even from a tundish to casting moulds. To transfer liquid between the two containers use is generally made of a tube, such as a pouring tube, which is kept pressed against the first container, for example against a flow control valve positioned in the bottom of this container.

In general, when the casting tube is brought against the container, pouring is halted. However, sometimes the tube is brought in or withdrawn while the metal is being poured, for example to prevent hardening of the metal as a result of the stopping of the pouring, or alternatively if use is being made of calibrated plates, that cannot be closed.

However, bringing the tube in or withdrawing it during the process of pouring is a risky business because the jet may splash and injure an operator.

BRIEF DESCRIPTION OF THE INVENTION

It is notably an object of the present invention to propose a safer casting installation.

To this end, a notable object of the invention is a tube for pouring liquid metal from a metallurgical container, the tube delimiting a pouring channel having a pouring axis, the tube comprising a downstream part, in which the pouring channel has a diameter known as the outlet diameter, and an upstream part which is defined as being that part of the tube that lies between an upper transverse plane, tangential to the upper end of the tube, and a lower transverse plane lying a distance, known as the threshold distance, from the upper transverse plane, the threshold distance having a dimension greater than four times the outlet diameter, the upstream part being flared. The tube is configured in such a way that:

- its upper end has a convex overall shape in the axial direction and has a surface of intersection with the upper transverse plane of which the width (e) in the radial direction is less than half the outlet diameter,
- the upstream part is included within a first volume corresponding to the complementary part of an axisymmetric frustoconical volume having as its axis the pouring axis, and the generatrix of which forms an angle alpha ($\alpha$) greater than 5° with the pouring axis, the small base of the frustoconical volume corresponding to the surface of intersection of the lower transverse plane with the pouring channel,
- the upstream part is included within a second volume, delimited by a surface of revolution generated by an isosceles trapezium revolving about the pouring axis, the small base of the trapezium lying in the upper transverse plane, having as its centre the centre of the upper end of the tube and as its dimension a width equal to half the outlet diameter, the large base of the trapezium lying in the lower transverse plane and the two non-parallel sides of the trapezium together making an angle beta ($\beta$) less than 30°.

Thanks to the shape proposed hereinabove for the upstream part of the tube, it is possible to limit splashing or make the splashing less dangerous at the moment when the tube, which is being brought in or withdrawn during pouring, intersects the jet of liquid metal. In particular, thanks to the convex shape and narrow width of the upper end, the jet that intersects the tube is directed downwards on each side of the tube, which is less dangerous than when the end is flat and thick, or even concave, as in such cases the jet is sprayed towards the top of the tube and risks hitting an operator, especially at face level. Further, thanks to the relatively great length of the flared part and to the fact that it lies within a certain volume, the upstream part has surfaces capable of channelling the jet towards the downstream part of the tube. Specifically, thanks to the volume proposed hereinabove for the flared upstream part, those parts of the jet that ricochet off the internal surface of the upstream part will very probably then intersect some other part of this surface and then flow down inside the upstream part, thus preventing them from being thrown out of the tube. In particular, the frustoconical volume of angle alpha defines a first exclusion zone, in which there is no wall of the tube, guaranteeing that the upstream part is flared enough to be able to gather in a significant proportion of the jet leaving the container. Further, the second volume defined by the trapezium, the sides of which make the angle beta, guarantees firstly that the upstream part is not too flared, because if it were those parts of the jet that bounce off the inside of the upstream part would carry the risk of being thrown out of the tube, and secondly that the exterior surface of the upstream part has no projection that intersects the jet and that might cause the metal to ricochet towards the top of the tube.

It will be noted that the width of the upper end and that the second volume are defined according to the outlet diameter of the jet in the downstream part, and this is particularly advantageous. The reason for this is that the value of these parameters is defined more precisely because it so happens that the narrower the jet the smaller the width and volume need to be, and vice versa.

It must be understood that the upstream and downstream directions are defined with reference to the direction in which the liquid flows. Moreover, it will be appreciated that the axial direction of the tube coincides with the direction of gravity when the tube is in the pouring position, pressed against the container. It will also be understood that the expression "the upstream part is included within a volume" means that the material delimiting the tube, namely a refractory material, is within this volume. The interior surface of the tube is denoted by the surface delimiting the pouring channel of the tube. It will be noted that the tube can be attached to the container directly, or even indirectly when it is attached to an intermediate component secured to the container. It will further be noted that the upper end of the tube is an end via which the tube is coupled to the container, which corresponds to the top of the tube in the axial direction.

The tube may further comprise one or more of the following features, considered alone or in combination with one another.

- The threshold distance has a dimension approximately five times the outlet diameter.
- The angle alpha is between 5 and 15°, preferably between 5 and 10°, preferably approximately 7°.

The angle beta is between 10 and 30°, preferably between 15 and 25°, preferably approximately 20°.

According to an embodiment of the invention, the outer wall in the upstream part of the tube comprises a radius of curvature at the conical transition (i.e. the separation between the upper end of the tube and the remainder of the upstream part) so as to guide the liquid metal flow along the outer wall of the tube. In such a case, it is advantageous that the retaining device does not interfere with the liquid metal jet flowing along the wall. In a variant, the radius is eliminated. Instead the conical transition takes the shape o a sharp edge. The result is a flow separation from the tube outer wall and consequently, a deflection of the liquid metal jet from the tube outer wall away from the retaining device. Thereby, splashes due to liquid metal jet bouncing on the retaining device are reduced. In yet another variant designed to minimize contact of the liquid metal jet with the retaining device, the outer wall of the upstream part of the tube comprises a recess for hosting and protecting the retaining device.

According to an embodiment of the invention, the tube may be configured so that the outer wall of the upstream part of the tube contains a portion with a radius of curvature that is convex in vertical profile with respect to the body of the tube. According to an embodiment of the invention, the tube may be configured so that the outer wall of the upstream part of the tube contains a portion having an obtuse angle in vertical profile. According to an embodiment of the invention, the inner wall of the upstream part of the tube contains a portion that is linear in vertical profile between the upper end of the upstream part of the tube and the lower end of the upstream part of the tube. Alternatively expressed, the inner wall of the upstream part of the tube contains a portion that takes the form of a radial surface of a frustoconical volume. According to an embodiment of the invention, the inner wall of the upstream part of the tube contains a portion, with a radius of curvature that is convex with respect to the body of the tube, between the upper end of the tube and a portion of the inner wall of the upstream portion of the tube that is linear in vertical profile. According to an embodiment of the invention, the intersection of the upper end of the tube and the outer wall of the upstream part of the tube is an obtuse angle. According to an embodiment of the invention, the intersection of the upper end of the tube and the inner wall of the upstream part of the tube is an obtuse angle.

Another object of the invention is an assembly of a tube as defined hereinabove and of a metal frame to house the upper end of the tube.

Preferably, the metal frame comprises a housing to house the upper end of the tube, the housing having an end wall running substantially in the transverse direction, of which the width in the radial direction is less than half the outlet diameter of the tube.

Preferably also, the metal frame is attached to the metallurgical container, the frame comprising a seal that seals it against the container. This metal frame is, for example, attached underneath a regulating valve that regulates the pouring and is attached to the container. It is particularly advantageous for the tube to be attached to such a metal frame rather than to the flow control valve directly, because that allows the tube to be kept in the pouring position while a moving gate of the valve is being moved.

A further object of the invention is a metal frame for an assembly as defined hereinabove, to house a tube for pouring liquid metal.

BRIEF DESCRIPTION OF THE SEVERAL VIEWS OF THE DRAWINGS

The invention will be better understood from reading the description which follows, given solely by way of example and with reference to the drawings in which.

DETAILED DESCRIPTION OF THE INVENTION

Figure 1:
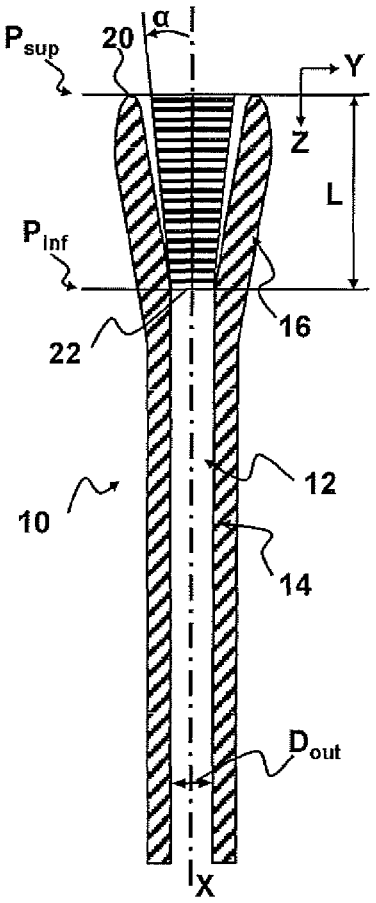
FIG. 1 is a view in axial section of a tube according to one embodiment.
Figure 5:
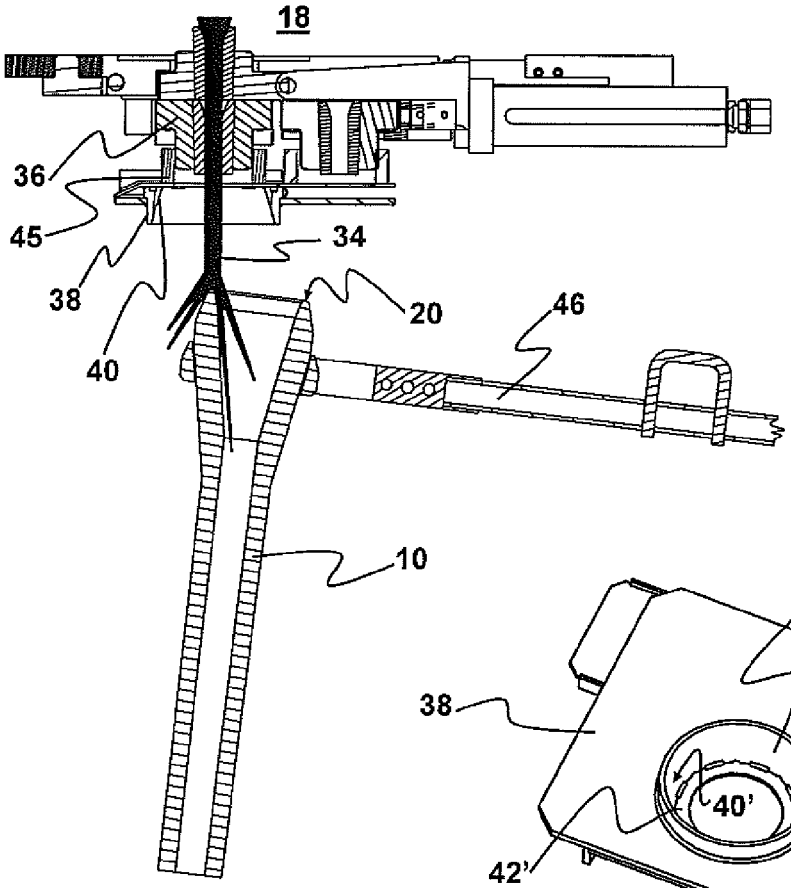
FIG. 5 is a view in axial section of part of a casting installation and of the tube of FIG. 1, at the moment at which it is attached to the metallurgical container.

FIG. 1 depicts a tube 10 for pouring liquid metal from a metallurgical container 18 part of which is visible in FIG. 5. In this example, the container 18 is a tundish bath and the tube 10 is a shrouding tube for transferring the metal from the tundish 18 to a continuous casting mould (for example a billet mould; not depicted in the figures).

The tube 10 delimits a pouring channel 12, having a pouring axis X that coincides with the vertical direction Z when the tube is in the pouring position, against the container 18. The tube 10 comprises a downstream part 14, positioned at the end from which the liquid metal emerges, and an upstream part 16 positioned at the end from which the liquid metal enters the tube, at the container 18 end.

The downstream part 14 is cylindrical, its interior surface and its exterior surface each having as their directrix curve a circle the centre of which is on the pouring axis and having as their directrix straight line the pouring axis X. The interior surface of the downstream part, delimiting the pouring channel 12, has an inside diameter $D_{out}$, known as the outlet diameter. Preferably, the diameter $D_{out}$ is between 20 and 50 mm (millimeters), for example approximately 25 mm. The exterior diameter may be between 50 and 90 mm, for example approximately 60 mm.

The upstream part 16 is defined as being that part of the tube 10 that lies between an upper transverse plane $P_{sup}$ and a lower transverse plane $P_{inf}$. The upper transverse plane $P_{sup}$ corresponds to the transverse plane that is tangential to the upper end 20 of the tube. This end 20 corresponds to the top of the tube 10 and is intended to be connected to the container 18, either directly or via a valve or a metal frame. The lower transverse plane $P_{inf}$ is a plane parallel to the plane $P_{sup}$ and lying a distance L from the upper transverse plane $P_{sup}$. The distance L is known as the threshold distance and is of a dimension greater than four times the outlet diameter $D_{out}$ ($L \geq 4 \times D_{out}$), preferably approximately 5 times that diameter ($L \cong 5 \times D_{out}$). It will be understood that the transverse planes $P_{inf}$ and $P_{sup}$ are mutually parallel planes which are perpendicular to the pouring axis X.

The upstream part 16 is also flared.

Figure 4A:
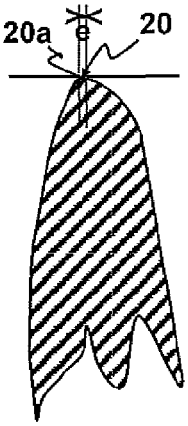
FIGS. 4*a* and 4*b* are views similar to that of FIG. 3, illustrating two types of end of the tube.
Figure 4B:
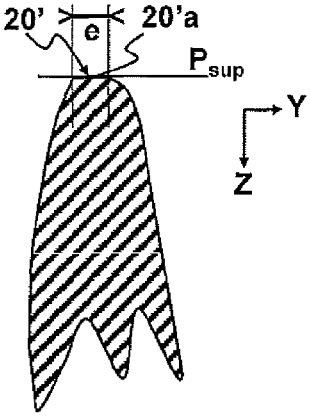

The upper end 20 of the upstream part has a convex overall shape in the axial direction X. It has a surface 20*a* of intersection with the upper transverse plane $P_{sup}$, visible in FIG. 4*a*. The width e of the surface 20*a* in the radial direction Y is less than half the outlet diameter $D_{out}$ ($e \leq 0.5 \times D_{out}$). This width e may be approximately 0 when the top is very thin and the surface of intersection 20*a* practically corresponds to a circle, or may be greater when the top is a little wider, as illustrated by the top 20' in FIG. 4*b*, where the surface of intersection 20'*a* has the shape of an annulus of thickness e in the radial direction Y.

Figure 2:
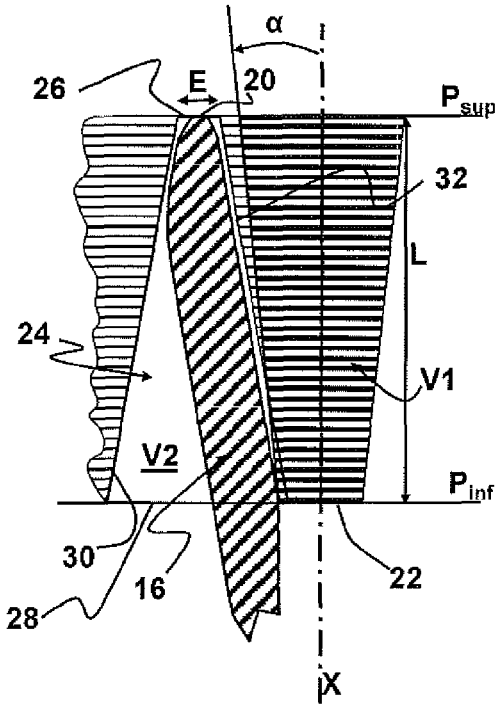
FIG. 2 is an enlarged view of the upstream part of the tube of FIG. 1.

The upstream part is included within a first volume that corresponds to the complementary part of an axisymmetric frustoconical volume $V_1$, illustrated notably in FIG. 2. This axisymmetric frustoconical volume $V_1$ has as its axis the pouring axis X and its generatrix makes an angle alpha (α) greater than 5° with the pouring axis X. The small base 22 of the frustoconical volume $V_1$ corresponds to the surface of intersection of the lower transverse plane $P_{inf}$ with the pouring channel 12. The angle alpha more specifically is between 5 and 15°, preferably between 5 and 10°, and in this example approximately 7°.

Figure 3:
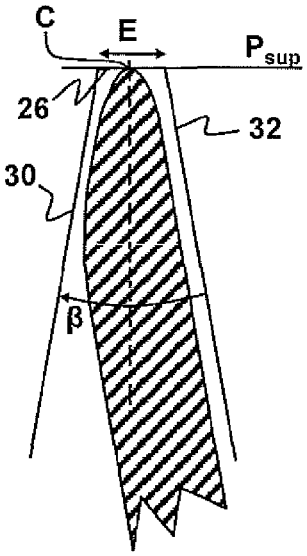
FIG. 3 is an enlarged view of FIG. 2.

The upstream part 16 is also included within a second volume $V_2$ illustrated in FIG. 2. The volume $V_2$ is delimited by a surface of revolution generated by an isosceles trapezium 24 revolving about the pouring axis X, the small base 26 of the trapezium lying in the upper transverse plane $P_{sup}$, having as its centre the centre C of the upper end 20 of the tube and as its dimension a width E equal to half the outlet diameter $D_{out}$ ($E=0.5 \times D_{out}$). The large base 28 of the trapezium 24 lies in the lower transverse plane $P_{inf}$, and the two non-parallel sides 30, 32 of the trapezium 24 together make an angle beta (β) visible in FIG. 3. This angle beta is less than 30°. More specifically, it is between 10 and 30°, preferably between 15 and 25°, and in this example, approximately 20°.

As can be seen in FIG. 5, the shape of the upstream part 16 considerably limits splashing when the tube 10 is brought in or withdrawn without stopping the pouring as illustrated by the jet 34. Further, the few splashes there are directed downward at a small angle of incidence, and this limits the risk of them reaching an operator or damaging the installation.

The tube 10 can be attached directly to the container 18, for example fitted on a pouring element such as a nozzle 36 or onto a flow control valve borne by the container 18. In a particularly advantageous embodiment, the tube 10 is accepted by a metal frame 38 that houses the upper end 20 of the tube.

The metal frame 38 comprises a housing 40 to house the upper end 20 of the tube, this housing having a horizontal end wall, running substantially in the transverse direction Y, and of which the width in the radial direction is less than half the outlet diameter $D_{out}$, so that it can house and position the end 20 of the tube. The housing 40 has a flared wall, of a shape that more or less complements that of the exterior surface of the volume $V_2$.

Figure 6:
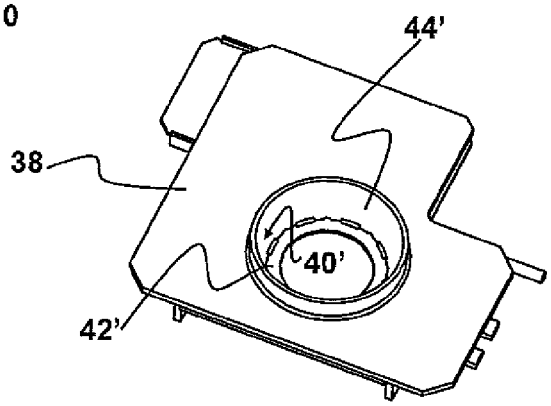
FIG. 6 is a perspective view from beneath of a metal frame that accommodates the tube of FIG. 1.
Figure 7:
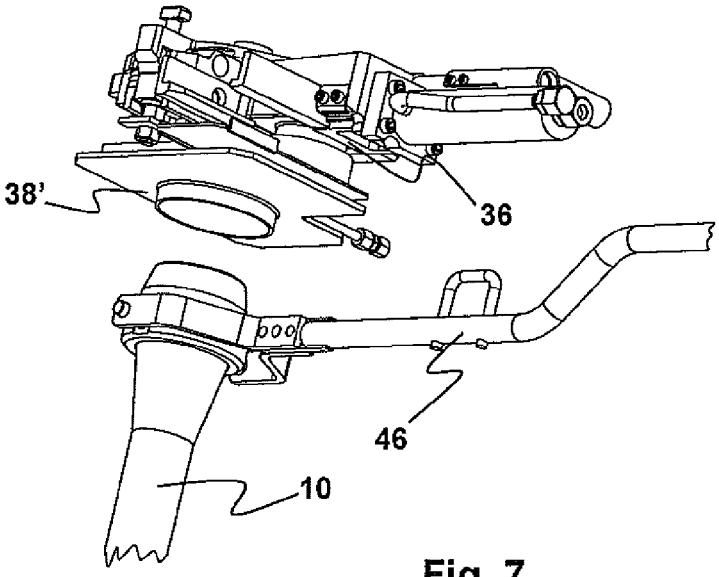
FIG. 7 is a perspective view from underneath of part of a casting installation and of the tube of FIG. 1, at the moment that it is attached to the metal frame of FIG. 6.

Another example 38' of metal frame is illustrated in FIGS. 6 and 7. This frame 38' also has a tube-accepting housing 40', with a horizontal end wall 42', of a width that complements the width of the top 20 of the tube, and with a flared wall 44' of a shape that more or less complements that of the exterior surface of the volume $V_2$.

As can be seen from the figures, the metal frame 38, 38' is attached to the metallurgical container 18, the frame comprising a seal 45 that seals against the container. This metal frame is, for example, attached underneath the nozzle 36 by a retaining device 46, making it possible to standardize the connection between the tube 10 and the nozzle 36.

It will be noted that the invention is not restricted to the examples described hereinabove nor to the embodiments illustrated in the drawings. Accordingly, it should be understood that where features mentioned in the appended claims are followed by reference signs, such signs are included solely for the purpose of enhancing the intelligibility of the claims and are in no way limiting on the scope of the claims.

It will be appreciated that the tube 10 and the frame 38, 38' improve the safety of a casting installation.

We claim:

1. Tube for pouring liquid metal from a metallurgical container, the tube delimiting a pouring channel having a pouring axis (X), comprising a downstream part, in which the pouring channel has a diameter known as the outlet diameter ($D_{out}$), and an upstream part which is defined as being that part of the tube that lies between an upper transverse plane ($P_{sup}$), tangential to the upper end of the tube, and a lower transverse plane ($P_{inf}$) lying a distance (L), known as the threshold distance, from the upper transverse plane ($P_{sup}$), the threshold distance having a dimension greater than four times the outlet diameter ($D_{out}$), the upstream part being flared and being configured in such a way that:

its upper end has a convex overall shape in the axial direction (X) and has a surface of intersection with the upper transverse plane ($P_{sup}$) of which the width (e) in the radial direction (Y) is less than half the outlet diameter ($D_{out}$), the upstream part is included within a first volume corresponding to the complementary part of an axisymmetric frustoconical volume ($V_1$) having as its axis the pouring axis (X), and the generatrix of which forms an angle alpha (a) greater than 5° with the pouring axis (X), the small base of the frustoconical volume ($V_1$) corresponding to the surface of intersection of the lower transverse plane with the pouring channel, the upstream part is included within a second volume ($V_2$), delimited by a surface of revolution generated by an isosceles trapezium revolving about the pouring axis (X), the small base of the trapezium lying in the upper transverse plane ($P_{sup}$), having as its centre the centre (C) of the upper end of the tube and as its dimension a width (E) equal to half the outlet diameter ($D_{out}$), the large base of the trapezium lying in the lower transverse plane ($P_{inf}$) and the two non-parallel sides of the trapezium together making an angle beta (β) less than 30°, and an outer wall of the upstream part of the tube contains a portion with a radius of curvature that is convex in vertical profile with respect to the body of the tube.

2. Tube according to claim 1, in which the threshold distance (L) has a dimension approximately 5 times the outlet diameter ($D_{out}$).

3. Tube according to claim 1, in which the angle alpha is between 5 and 15°.

4. Tube according to claim 1, in which the angle beta is between 10 and 30°.

5. Assembly of a tube according to claim 1 and of a metal frame to house the upper end of the tube.

6. Assembly according to claim 5, in which the metal frame comprises a housing to house the upper end of the tube, the housing having an end wall running substantially in the transverse direction, of which the width in the radial direction is less than half the outlet diameter ($D_{out}$) of the tube.

7. Assembly according to claim 5, in which the metal frame is attached to the metallurgical container, the frame comprising a seal that seals it against the container.

8. Metal frame for an assembly according to claim 5, to house a tube for pouring liquid metal.

9. Tube according to claim 1, wherein the outer wall of the upstream part of the tube contains a portion having an obtuse angle in vertical profile.

10. Tube according to claim 1, wherein the upstream part of the tube comprises an upper end and a lower end, and inner wall of the upstream part of the tube contains a portion that is linear in vertical profile between the upper end and the lower end.

11. Tube according to claim 1, wherein the inner wall of the upstream part of the tube contains a portion that takes the form of a radial surface of a frustoconical volume.

12. Tube according to claim 1, wherein the inner wall of the upstream part of the tube contains a portion, with a radius of curvature that is convex with respect to the body of the tube, between the upper end of the tube and a portion of the inner wall of the upstream part of the tube that is linear in vertical profile.

13. Tube according to claim 1, wherein, the intersection of the upper end of the tube and the outer wall of the upstream part of the tube is an obtuse angle.

14. Tube according to claim 1, wherein the intersection of the upper end of the tube and the inner wall of the upstream part of the tube is an obtuse angle.

* * * * *